US010773149B2

(12) United States Patent
Hammer

(10) Patent No.: US 10,773,149 B2
(45) Date of Patent: Sep. 15, 2020

(54) SPORTS SHIN GUARD WITH CUT-RESISTANT SLEEVE

(71) Applicant: Bryan Hammer, Catonsville, MD (US)

(72) Inventor: Bryan Hammer, Catonsville, MD (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 838 days.

(21) Appl. No.: 14/982,847

(22) Filed: Dec. 29, 2015

(65) Prior Publication Data

US 2016/0213996 A1 Jul. 28, 2016

Related U.S. Application Data

(60) Provisional application No. 62/107,971, filed on Jan. 26, 2015.

(51) Int. Cl.
*A63B 71/00* (2006.01)
*A63B 71/12* (2006.01)

(52) U.S. Cl.
CPC .... *A63B 71/1225* (2013.01); *A63B 2071/125* (2013.01); *A63B 2071/1258* (2013.01); *A63B 2071/1266* (2013.01); *A63B 2209/10* (2013.01)

(58) Field of Classification Search
CPC combination set(s) only.
See application file for complete search history.

(56) References Cited

U.S. PATENT DOCUMENTS 3,135,964 A * 6/1964 Pender ..... A63B 71/1225 2/22
4,370,978 A * 2/1983 Palumbo ..... A61F 13/062 602/26
4,692,946 A * 9/1987 Jurga ..... A63B 71/1225 2/22
4,715,067 A * 12/1987 Beauregard ..... A63B 71/1225 2/22
5,477,559 A * 12/1995 Clement ..... A63B 71/1225 2/22
5,491,840 A * 2/1996 Yen ..... A41D 13/05 2/16
5,611,080 A * 3/1997 Skottheim ..... A41D 13/0568 2/16
5,625,896 A * 5/1997 LaBarbera ..... A63B 71/1225 2/22
5,688,038 A * 11/1997 Chien ..... A41D 13/01 362/103

(Continued)

*Primary Examiner* — Richale L Quinn
(74) *Attorney, Agent, or Firm* — Royal W. Craig; Gordon Feinblatt LLC

(57) ABSTRACT

A protective shin guard includes a floating knee section hingedly attached to a shin section, both sections being formed of one or more hard shell panels. The floating knee section is attached to the shin section by a main padding layer, and a liner is attached beneath the main padding layer. The liner includes an integral cut-resistant calf-sleeve attached along its bottom edge and extending downward. The cut-resistant calf-sleeve is an elastic tubular sleeve formed of a weave of elastic/cut-resistant fibers, e.g., Kevlar® and Spandex. The cut-resistant calf-sleeve is long enough to surround both the calf and the ankle. The cut-resistant calf-sleeve also provides a lower attachment feature that combines with an upper 360+ degree attachment strap to provide a better fit that will not shift or come loose during play.

30 Claims, 5 Drawing Sheets

(56) References Cited

U.S. PATENT DOCUMENTS 5,711,029 A * 1/1998 Visco ..... A41D 13/0568 2/22
5,717,996 A * 2/1998 Feldmann ..... A61F 5/0111 2/22
D392,074 S * 3/1998 Witkin ..... D29/122
5,918,319 A * 7/1999 Baxter ..... A41D 1/067 2/22
5,943,695 A * 8/1999 Yen ..... A63B 71/1225 2/16
6,128,779 A * 10/2000 Goldsmith ..... A41D 13/065 2/22
6,178,556 B1 * 1/2001 Foreman ..... A63B 71/08 128/882
6,336,220 B1 * 1/2002 Sacks ..... A41D 31/005 116/203
6,553,572 B2 * 4/2003 Fiorini ..... A41D 13/065 2/22
6,654,961 B2 * 12/2003 Beland ..... A63B 71/1225 2/22
6,687,912 B2 * 2/2004 Collins ..... A41D 13/0568 2/22
7,003,803 B1 * 2/2006 Lyden ..... A41D 13/0153 2/22
7,841,018 B2 * 11/2010 Kotoske ..... A41D 13/0562 2/22
7,937,768 B2 * 5/2011 Behrend ..... A41D 13/0543 2/2.5
8,661,564 B2 * 3/2014 Dodd ..... A41D 13/0153 2/22
9,173,438 B2 * 11/2015 Blumenfeld ..... A63B 71/1225
9,339,067 B2 * 5/2016 Feuchs ..... A41D 13/065
9,643,053 B2 * 5/2017 Guiney ..... A63B 27/00
9,656,149 B2 * 5/2017 Hughes ..... A63B 71/1225
9,770,645 B2 * 9/2017 Stevens ..... A63B 71/1225
D800,420 S * 10/2017 Rivera ..... D2/731
2009/0100563 A1 * 4/2009 Behrend ..... A41D 13/0543 2/22
2013/0198922 A1 * 8/2013 Wittman ..... A41D 13/0543 2/22
2013/0283491 A1 * 10/2013 Clement ..... A41D 13/0543 2/22
2017/0000196 A1 * 1/2017 Rivera ..... A41D 13/08
2018/0153233 A1 * 6/2018 Paquette ..... A41D 13/08
2018/0214764 A1 * 8/2018 Reixachs Ferrer ..... A41D 13/0543

* cited by examiner

SPORTS SHIN GUARD WITH CUT-RESISTANT SLEEVE

CROSS-REFERENCE TO RELATED APPLICATION(S)

The present application derives priority from U.S. Provisional Patent Application Ser. No. 62/107,971 filed 26 Jan. 2015.

BACKGROUND OF THE INVENTION

1. Field of the Invention

The present invention relates generally to protective sports equipment and, in particular, ice hockey shin guards with a cut-resistant sleeve that covers a user's exposed lower leg.

2. Description of the Background

Protective sports equipment is commonly used and often required many organized sports such as lacrosse, hockey and other contact sports. For example, shin guards are common precautions against painful contusions to the lower leg when the shin is kicked by another player or is struck by a puck or ball. Conventional field hockey shin guards are typically fabric-encased rubber pads and/or rigid plates, with elasticized fabric straps that wrap around the back of the leg. Conventional ice hockey shin guards typically feature a molded plastic outer layer and a softer inner padding layer with elastic straps that wrap partially around the leg to keep the shin guard in place. These conventional shin guards protect against frontal impact but offer no cut protection in the areas most prone.

Recent injuries in ice hockey have made this cut-type of injury a serious topic for improvement. In 2012 Erik Karlsson won the James Norris Memorial Trophy as the National Hockey League top defense player. In 2013 he was retrieving the puck in the corner when the skate of an opposing player sliced into the back of his left foot. Karlsson's Achilles tendon was nearly severed and his season ended. There have been many similar incidents, and short-track speed skating is another sport where skate cuts are common.

Both cut-proof and cut-resistant socks are available but skaters and players find them uncomfortable and rarely wear them. Alternative heavy knitted yarn socks do not adequately protect the ankle area and adversely affect skate fit and comfort. Sleeved shin guards are known in the sport of field hockey, but are configured differently from the present invention, including having a rigid plate essentially built into the front portion of a sleeve to cover a portion of a user's lower leg. Such shin guards often include a stirrup that extends underneath the foot. The objectives of shin guards designed for blade sports, such as ice hockey, and those designed for field hockey overlap somewhat, but the articles are otherwise of a different genus.

What is needed is a protective shin guard with integral cut protection about the ankle that will not shift or come loose during play and will not affect skate fit or comfort

SUMMARY OF THE INVENTION

One object of the present invention is to provide a shin guard that protects the shin and knee from impacts.

Another object is to combine an enhanced level of integral cut protection without obstructing forward flex and mobility of a skater's leg.

Another object of the present invention is to provide a shin guard with integral cut protection about the ankle without affecting skate fit.

Yet another object of the present invention is to provide a shin guard that facilitates donning and lacing of skates with shin guard on.

In one aspect, a protective shin guard includes a floating knee section hingedly attached to a shin section, both sections being formed of a hard shell panel. The floating knee section is attached to the shin section by a main padding layer that underlies both hard shell panels. The main padding layer may be formed of one or more contiguous blocking panels of compressible foam (e.g., high-density microcellular polyurethane foam), or similarly by fabric layers cut-and-sewn together to encase foam pads.

A liner is attached beneath the main padding layer. In one embodiment the liner is removable using hook-and-loop pads or the like. The liner can also be permanently attached by sewing, soldering or other conventional means. The liner may likewise be formed of one or more contiguous blocking panels of compressible foam or by foam pads encased in hinged fabric layers. In either case, the liner may be formed with a particular hinge pattern including a radial array centered at the knee section, a lateral hinge beneath the knee cap, and a plurality of spaced vertical hinges extending down the shin.

The liner also includes an integral cut-resistant calf-sleeve attached along its bottom edge and extending downward. The cut-resistant calf-sleeve may be an elastic tubular sleeve formed of a weave of elastic/cut-resistant fibers, e.g., Kevlar®, Spandex, Dyneema®, fiberglass coated yarn, or the like. Alternatively, the calf-sleeve may be formed of non-cut-resistant fibers that are either treated or coated in such a way as to make the sleeve cut-resistant. One such coating material is commercialized under the tradename SuperFabric®, produced by HDM, Inc. of Oakdale, Minn. The cut-resistant calf-sleeve is long enough to surround both the calf and the ankle, and thereby provides integral cut protection about the ankle without compromising skate fit and comfort. It also provides a lower attachment feature that combines with an upper 360+ degree attachment strap to provide a better fit that will not shift or come loose during play.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 4(A-C) is a sequential assembly view of the steps (A-C) involved in donning the shin guard 2.

FIG. 5(E-H) is a composite view illustrating the coverage of the shin guard 2 with cut-guard sleeve 8 compared to a conventional shin guard in FIG. 5(A-D).

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

The embodiments of the present invention described herein all regard a protective shin guard that employs a particular impact-resistant hard-shell outer assembly and shock-absorptive inner liner. The main outer assembly employs a first flex-padding configuration comprising a floating hard-shell knee section attached to a hard-shell shin section by a main padding layer, and flanking side panels hingedly attached to the hard-shell shin section by the main padding layer. The inner liner may be removably attachable inside the main outer assembly by hook-and-loop. Alternatively, the liner can be permanently attached by sewing, soldering or other conventional means. The liner employs a second flex-padding configuration and includes a cut-resistant calf-sleeve attached at its lower extremity to provide cut protection to the lower calf and ankle.

The shin guard is attached to the leg by the cut-resistant calf-sleeve in combination with a behind-the-knee strap. The knee strap is a 360+ degree compression strap, preferably elastic, that wraps fully around the leg and works in conjunction with flanking side leg panels to pull them in from all sides for a secure compression fit.

Figure 1:
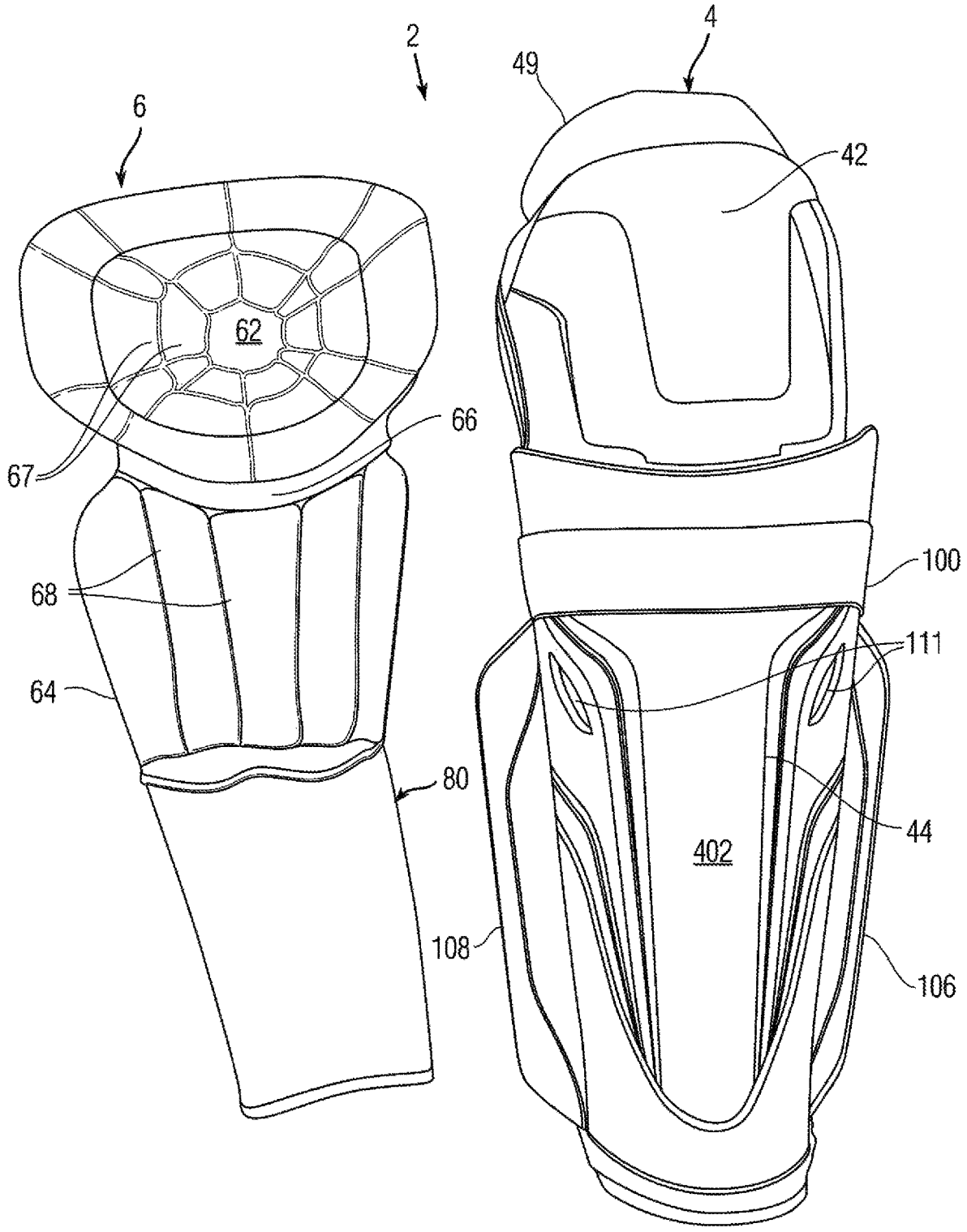
FIG. 1 is a front perspective exploded view of the shin guard 2 shown with removable liner 6 removed from main outer assembly 4.
Figure 2:
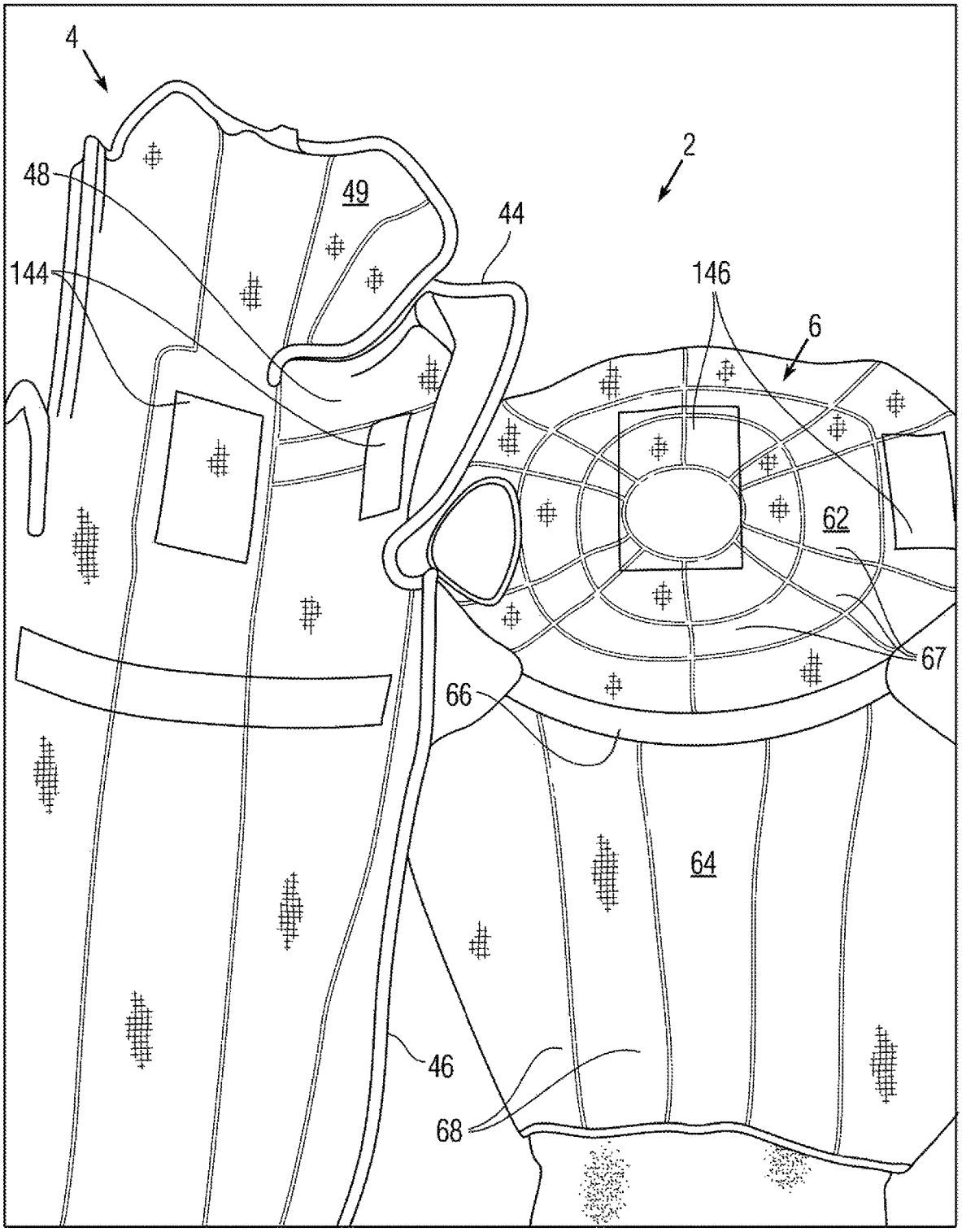
FIG. 2 is a rear perspective exploded view of the shin guard 2 with liner 6 removed from main outer assembly 4.

Referring to FIGS. 1-2, a first embodiment of a protective shin guard 2 of the type worn for ice-hockey is shown according to the invention. The protective shin guard 2 generally comprises the main outer assembly 4 (at right) and liner 6 (at left, shown detached from main outer assembly 4). The main outer assembly 4 includes a floating knee section 42 and a shin section 44 connected to one another by main padding, layer 48 that covers a substantial portion of the interior of both sections 42, 44. One skilled in the art will understand that the connection between the floating knee section 42 and shin section 44 may alternately be by pins, flexible hinges, or may be in any other suitable manner. Both floating knee section 42 and shin section 44 may be integrally-molded from impact resistant plastic such as nylon or polycarbonate. Alternately, one or both floating knee section 42 and shin section 44 of the main outer assembly 4 may comprise a plurality of articulated panel(s), in either case the shin section 44 is trough-shaped adapted to conform to the leg of the wearer, with a generally arcuate cross-section profile. The knee section 44 is generally concave and conforms to the knee.

The illustrated embodiment of shin section 44 can include a central Y-shaped shin bone panel 402 seated within a conforming U-shaped bottom panel 404, and two flanking side leg panels 106, 108. The hard shell outer panel(s) of the shin section 16 may also include one or more pass-through vents 111 into the padding layer 20 for air circulation.

As seen in FIG. 2, the floating knee section 42 is attached to the shin section 44 by the main padding layer 48 which underlies the hard shell panels. The main padding layer 48 is a thin layer of padding and may be a single fabric layer, but is more preferably formed of one or more contiguous blocking panels of compressible foam (e.g., high-density microcellular polyurethane foam) hinged together, or by opposing fabric layers cut-and-sewn together to encase foam pads.

Also seen in FIG. 2, is an optionally removable and adjustable knee cushion 49 formed of one or more contiguous blocking panels of compressible foam hinged together, or by opposing fabric layers cut-and-sewn together to encase foam pads. Knee cushion 49 is a small transitional pad attached at the top of the knee section 44 that softens the edge of the knee section 44 against the lower thigh and protects the lower thigh area. If attached by strap, knee cushion 49 can be adjusted to cover more or less of a user's thigh. If removable, knee cushion 49 is preferably attached by hook-and-loop so as to be easily removable and washable.

Figure 3A:
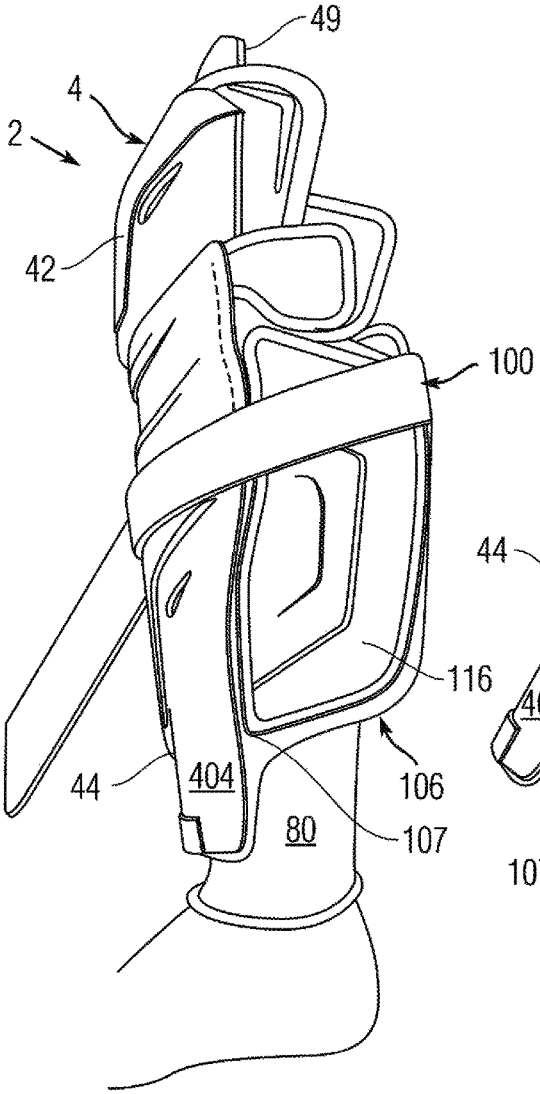
FIG. 3(A-B) is a composite side-view illustration of the shin guard 2 illustrating the hinge function of the main outer assembly relative to the removable liner, shown in the playing position at FIG. 3(A) and in the raised position as at FIG. 3(B) for fining over the hockey skate when dressing.
Figure 3B:
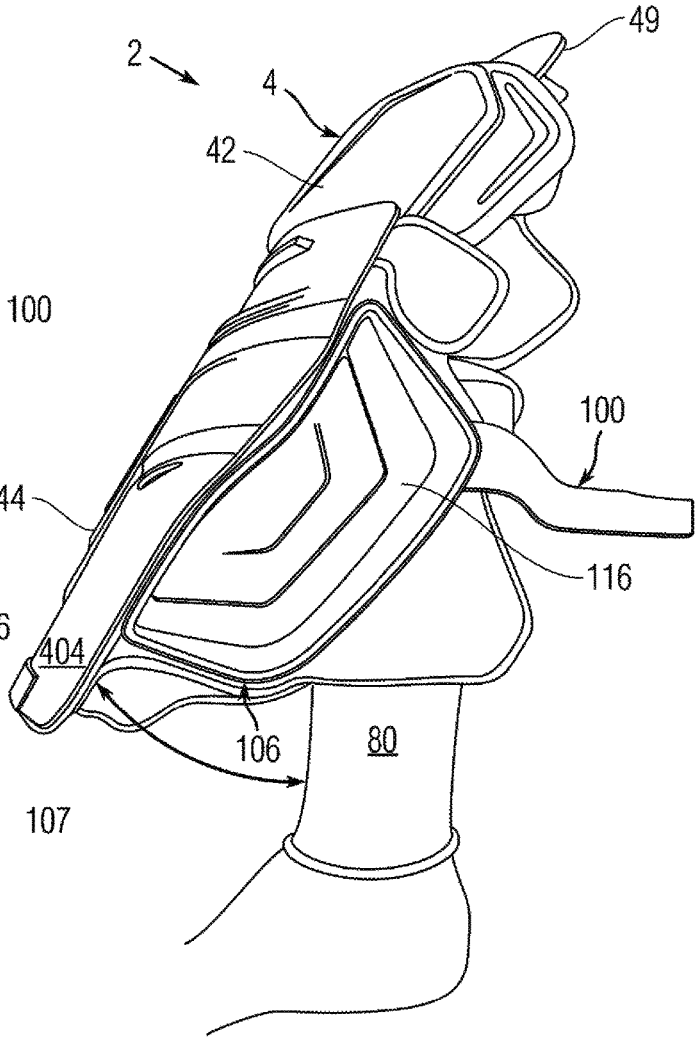

In the illustrated embodiment, as seen in FIG. 3, the main padding layer 48 is extended on each side to form opposing side leg panels 106, 108, the latter being hinged to the main padding layer beneath shin bone panel 402 by selected molded or sewn bridge areas of reduced material thickness. These bridge areas effectively form living binges 107, 109 (FIG. 3) which add flexibility, allowing the side panels 106, 108 to pivot with respect to the U-shaped bottom panel 404. In addition, side leg panels 106, 108 may include overlying pads 116, 118 of high density foam for increased side-impact protection.

Referring back to FIGS. 1-2, liner 6 includes an upper knee pad 62 joined to a lower shin pad 64 at a hinge 66. Liner 6 is removably or permanently attached beneath the main padding layer 44 for skin contact. If removable, liner 6 is preferably attached by hook-and-loop so as to be easily removable and washable. The knee pad 62 is optionally attached to the main padding layer 48 using multiple pieces of hook-and-loop. In the illustrated embodiment, three hook-or-loop pads 144 are spaced along the main padding layer 44 and three mating pads 146 spaced along liner 6 to index the position of liner 6. It is important that the hook-and-loop pads 144, 146 not extend below the knee cap area in order to allow liner 6 to hinge properly as described below.

Liner 6 is preferably formed of one or more contiguous blocking panels of compressible foam (e.g., high-density microcellular polyurethane foam) hinged together, or by opposing fabric layers cut-and-sewn together to encase foam pads. The knee pad 62 is roughly circular to occupy the interior of concave knee section 44, and may be defined by a spider-web array of hinges 67. Lower shin pad 64 is roughly crest-shaped and may be defined by an array of spaced vertical hinges 68. Importantly, hinge 66 occurs beneath the knee cap.

Liner 6 includes a cut-resistant calf-sleeve 80 attached to the lower shin pad 64. Cut-resistant calf-sleeve 80 is formed of a cut-resistant yet stretchable material comprising a woven fabric blend of two separate fibers, the first being an ultra-high-molecular-weight polyethylene high-performance material such as DuPont™ Kevlar® aramid or Dyneema® fiber and the second being an elasticized fiber such as Spandex®. The two fiber strands are knitted together in an overall resulting fabric blend at weight percentages as desired to provide a particular level of cut resistance. Preferably the resulting fabric blend may be 60-90 weight percent (%) of the high-performance fiber and 10-40% of the elastic fiber which provides an acceptable range of cut resistance. There are three standardized methods for testing cut resistance: ASTM F1790 (U.S.), ISO 13997 (International) and EN 388 (Europe), and for present purposes at least an ANSI/ISEA 105-2011 performance level 1 fabric should be used and "cut resistant" is herein defined as a fabric that exhibits a cut resistance level equal to or in excess of ANSI/ISEA 105-2011 (2011) performance level 1. Sleeve 80 may be treated or coated to achieve the desired level of cut resistance. The resulting fabric is sewn in the form of a tubular sleeve and as seen in FIG. 2 the upper front edge of the sleeve 80 is sewn or otherwise attached to the bottom edge of the lower shin pad 64 of liner 6. The cut-resistant calf-sleeve 80 is long enough to surround both the calf and the ankle, and thereby provides integral cut protection about the ankle without compromising skate comfort or fit. It also provides a lower attachment feature that combines with an upper 360+ degree attachment strap to provide a better overall fit of the shin guard that will not shift or come loose during play.

The shin guard 2 is attached to the leg by the cut-resistant calf-sleeve 80 in combination with a 360+ degree compression strap 100, best seen in FIG. 3. The 360+ degree compression strap 100 is preferably elastic, wraps fully around the leg and works in conjunction with the flanking side leg panels 106, 108 to pull them in from all sides for a secure compression fit. The 360+ compression strap 100 is an approximately one-to-two foot long section of webbing fixedly attached on one side of the shin guard 2. The 360+ compression strap 100 extends at about a 45 degree angle upward and outward from the upper corner of the side panel 106. A distal attachment pad 102 is mounted on the end of 360+ compression strap 100, with inwardly-facing hook material and preferably an outwardly tacky rubberized surface to serve as a pull-tab. The entire outwardly-facing back surface of 360+ compression strap 100 (except for attachment pad 102) bears opposing loop material. In use, the player pulls the 360+ compression strap 100 back and wraps it around the top of the calf, moving from outside, back and around inside to the front of the shin guard 2, and around front of the leg until the 360+ compression strap 100 has made a 360 degree rotation around the shin guard 2. At this point, and given a comfortable tension, the distal attachment pad 102 is then secured to the medial attachment pad to secure the shin guard 2 in place, importantly, the 360+ compression strap 100 cannot be fastened until the player first wraps it more than 360 degrees around the leg. Only past this point may the inwardly-facing hook material of distal attachment pad 102 be secured to the outwardly facing loop material on the back surface of 360+ compression strap 100 to secure the strap 100 for proper hold. Optional elevated channels may be formed in the exterior surface of shin section 44 to guide and constrain the path of the 360+ compression strap 100, and to prevent sliding of the 360+ compression strap 100 during play. The hinged leg panels 106, 108 allow the 360+ degree strap 100 to compress inward from the sides, front and back allowing for a 360 compression hold around the leg for a more secure retention.

FIG. 3 also illustrates the hinge function of the main outer assembly 4 relative to liner 6. The cut-proof sleeve 80 maintains the mire shin guard 2 on the leg, but cut-proof sleeve 80 is not directly attached to the main outer assembly 4. Only the upper knee pad 62 is joined to a lower shin pad 64 at hinge 66, and so once the 360+ degree compression strap 100 is loosened (as at A) the shin guard 2 can be pivoted outward (as at B) relative to the removable liner 6. Thus, the shin guard 2 is shown in the playing position at A and in the raised position as at B, and this pivoting feature allows the wearer to simply raise it rather than taking it off when donning or lacing skates. This aspect of the disclosure would be welcomed relief for ice hockey players that would prefer to have shin guards in place before donning or doffing skates.

Figure 4C:
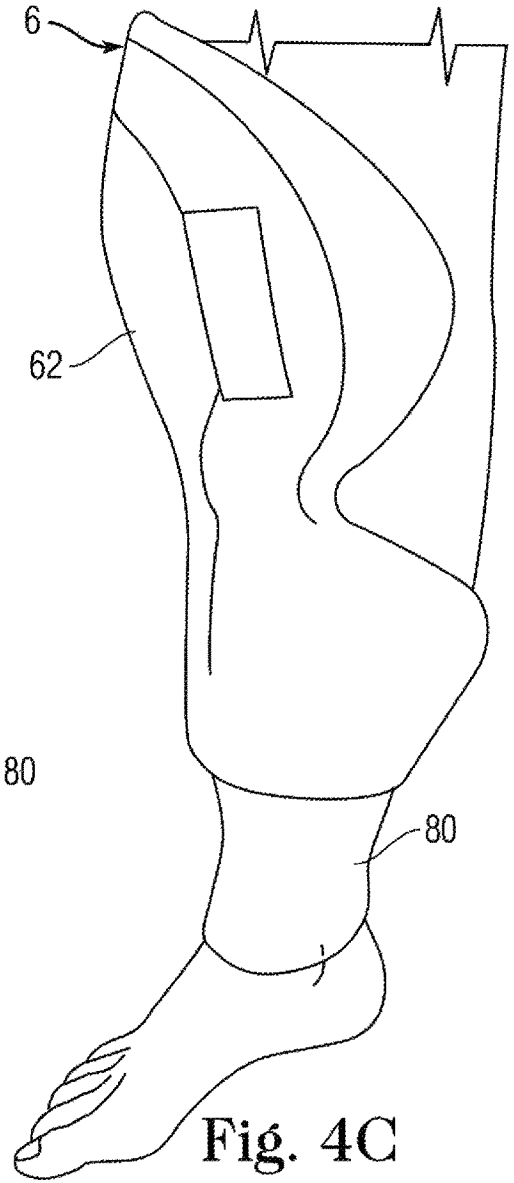
FIG. 4(C) is a perspective view of the liner fully in place.
Figure 4B:
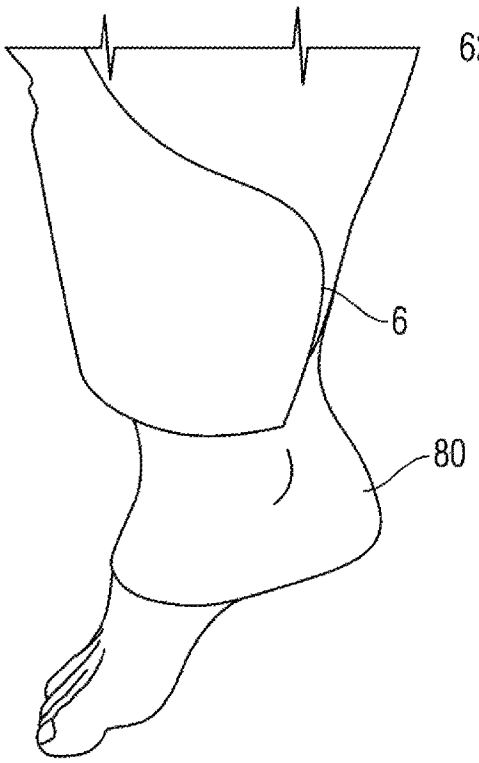
FIG. 4(B) is a side perspective view of the liner partially in place.
Figure 4A:
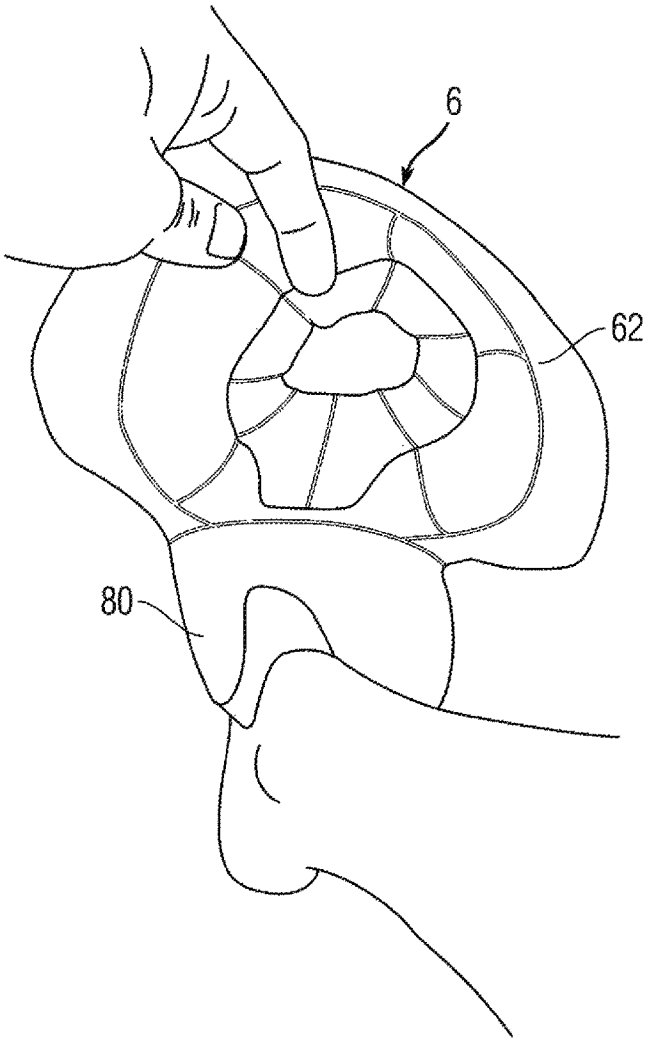
FIG. 4(A) is a perspective view of the liner removed from the main outer assembly and being donned separately, though the liner may be permanently attached to the main assembly piece and need not be donned separately.
Figure 5A:
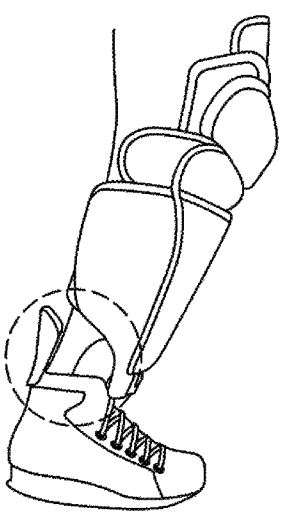
FIG. 5(A) is right-side view illustrating a conventional shin guard.
Figure 5B:
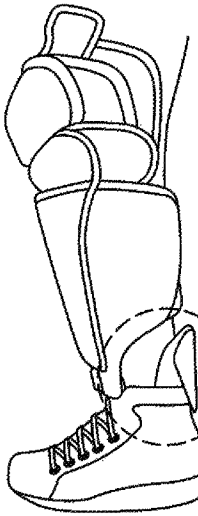
FIG. 5(B) is left-side view illustrating the conventional shin guard.
Figure 5C:
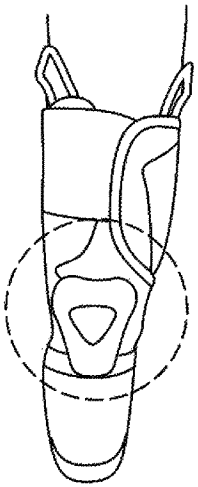
FIG. 5(C) is rear view of the conventional shin guard.
Figure 5D:
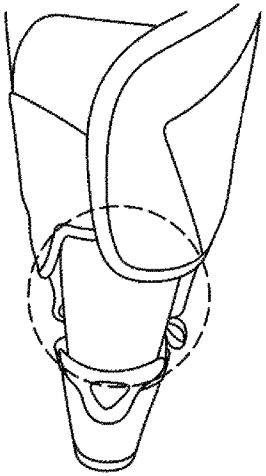
FIG. 5(D) is rear perspective view of the conventional shin guard 2 illustrating its lack of cut protection.
Figure 5E:
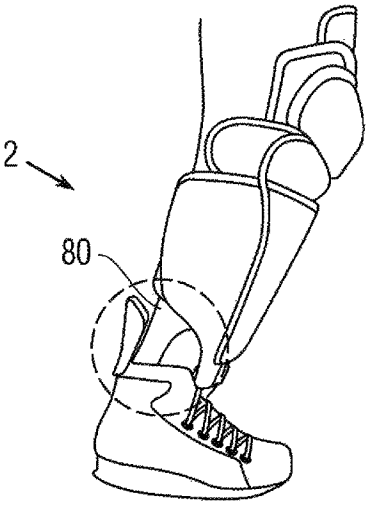
FIG. 5(E) is right-side view illustrating the shin guard 2 according to the present invention with cut-guard sleeve 8.
Figure 5F:
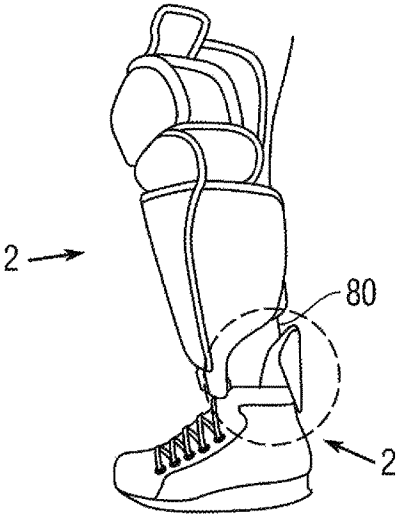
FIG. 5(F) is left-side view illustrating the shin guard 2 with cut-guard sleeve 8.
Figure 5G:
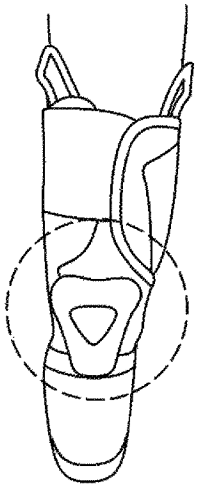
FIG. 5(G) is rear view of the shin guard 2 with cut-guard sleeve 8.
Figure 5H:
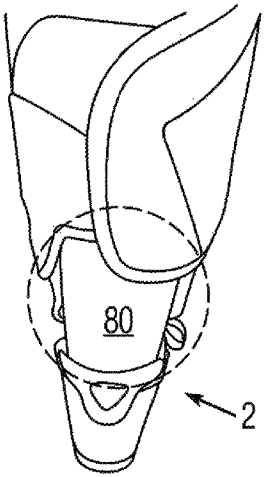
FIG. 5(H) is a rear perspective view of the shin guard 2 with cut-guard sleeve 8 illustrating its enhanced cut protection.

FIG. 4 is a sequential assembly view of the steps (A-C) involved in putting on the shin guard 2. Note: Liner 6 need not be separated from the main outer assembly before donning. As seen in FIG. 4(A), the player may don liner 6 first, sliding their foot down through the cut-resistant sleeve 80. The cut-resistant sleeve 80 is slid fully over the foot as at (B), until the upper knee pad 62 is seated atop the knee, hinge 66 is directly beneath the knee, and the lower shin pad 64 runs down the shin as seen at (C). Once liner 6 is on as at C, the main outer assembly 4 can be placed over it and 360+ degree compression strap 100 tightened as desired. The hinging function of the main outer assembly 4 relative to liner 6 allows the player to pull up and lift the shin guard 2 over the player's skate in order to secure the shin guard into position.

FIG. 5 is a composite view illustrating the coverage of the shin guard 2 with cut-guard sleeve 80 compared to a conventional shin guard. As seen at A-D conventional shin guards leave the heel mostly unprotected and prone to injury from other skates. However, as seen at E-H, the cut resistant sleeve 80 completely surrounds the heel, tucking beneath the shin guard 2 and skate collar. The woven fabric nature of sleeve 80 offers superior protection without compromising skate comfort and fit. The sleeve 80 also provides some 'compression' around the sides and back of the ankle for improved support.

It should now be apparent that the above-described protective shin guard 2 allows a user freedom of movement, especially in a hockey scenario, yet maximum protection and secure fit.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective shin guard, comprising:

a floating knee section comprising a concave knee cup having a hard plastic outer shell overlying a non-rigid inner padding layer;

a shin section joined to said knee section and comprising a rough-shaped member having a hard plastic outer shell overlying a non-rigid inner padding layer;

a fabric layer joining said floating knee section to said shin section;

a liner attachable to said fabric layer opposite said floating knee section, said liner comprising, an upper padding layer configured to cover a calf of a wearer, said upper padding layer including an upper knee pad hinged to a lower shin pad by a flexible hinge, and a tubular elastic sleeve configured to surround a shin of said wearer and formed with woven fibers into a cut-resistant material having at least an ANSI/ISEA 105-2011 performance level 1 cut-resistance rating, said tubular elastic sleeve being attached to said upper padding layer.

2. The protective shin guard according to claim 1, wherein said tubular elastic sleeve is configured to surround both a calf and ankle of a wearer.

3. The protective shin guard according to claim 2, further comprising a compression strap for attaching said shin guard to a leg of a wearer, said compression strap configured to wrap fully around the shin guard in a greater-than 360 degree loop.

4. The protective shin guard according to claim 1, further comprising a pair of opposing side panels hingedly-attached to said shin section.

5. The protective shin guard according to claim 4, further comprising a compression strap for attaching said shin guard to a leg of a wearer, said compression strap configured to wrap fully around the floating knee section and side in a greater-than 360 degree loop to compress said side panel inward.

6. The protective shin guard according to claim 1, wherein said inner liner comprises a cut-resistant stretchable material.

7. The protective shin guard according to claim 6, wherein said cut-resistant stretchable material comprises a woven fabric blend of two fibers including polyethylene fiber and an elasticized fiber.

8. The protective shin guard according to claim 7, wherein said woven fabric blend comprises a range of from 60-90 weight percent (%) of polyethylene fiber and elasticized fiber.

9. A protective shin guard, comprising:

a main outer assembly including a hard-shell knee section, a hard-shell shin section, and a padding layer attached beneath said hard-shell knee section and hard-shell shin section and hingedly attaching said hard-shell knee section and hard-shell shin section together;

an inner liner attached inside said main outer assembly, said inner liner including an upper knee pad configured to cover a knee of a wearer and a lower shin pad configured to cover a shin of said wearer; and a tubular cut-resistant calf-sleeve configured to surround a shin of said wearer and attached along an arc section of its circumference to the lower shin pad of the inner liner said cut-resistant calf-sleeve being formed of a woven blend of fibers including cut-resistant fibers and elasticized fibers into a stretchable material having at least an ANSI/ISEA 105-2011 performance level 1 cut-resistance rating, said tubular elastic sleeve providing 360 degree cut protection to the lower calf and ankle.

10. The protective shin guard according to claim 9, wherein said cut-resistant calf-sleeve is configured to surround both a calf and ankle of a wearer.

11. The protective shin guard according to claim 10, further comprising a compression strap for attaching said shin guard to a leg of a wearer, said compression strap configured to wrap fully around the shin guard in a greater-than 360 degree loop.

12. The protective shin guard according to claim 10, further comprising a pair of opposing side of panels hingedly-attached to and flanking the hard-shell knee section of said main outer assembly.

13. The protective shin guard according to claim 12, wherein said opposing side leg panels are hinged to the shin section of the main padding layer by integrally-molded areas of reduced material thickness.

14. The protective shin guard according to claim 13, wherein said opposing side leg panels are hinged to the shin section of the main padding layer by living hinges.

15. The protective shin guard according to claim 12, further comprising a compression strap for attaching said shin guard to a leg of a wearer, said compression strap configured to wrap fully around the hard-shell knee section and side panels of said main outer assembly in a greater-than 360 degree loop to compress said side panel inward.

16. The protective shin guard according to claim 9, wherein said inner liner is removably attachable inside the main outer assembly.

17. The protective shin guard according to claim 9, wherein said inner liner is permanently attached inside the main outer assembly.

18. The protective shin guard according to claim 9, wherein said inner liner comprises a flex-padding, configuration.

19. The protective shin guard according to claim 9, wherein said shin guard is attached to a leg of a wearer by a behind-the-knee strap and said tubular cut-resistant calf-sleeve.

20. The protective shin guard according to claim 12, wherein said opposing side leg panels are hinged to the shin section of the main padding layer by sewn hinges.

21. The protective shin guard according to claim 9, wherein said inner liner comprises a knee pad hingedly attached to a shin pad.

22. The protective shin guard according to claim 21, wherein said inner liner is removably attachable to said main outer assembly by hook-and-loop patches.

23. The protective shin guard according to claim 22, thriller comprising a plurality of hook-or-loop patches attached to the knee section of said inner liner and a plurality of mating hook-or-loop patches attached to the knee section of said main outer assembly.

24. The protective shin guard according to claim 23, further comprising three hook-or-loop patches attached to the knee section of said inner liner and three mating hook-or-loop patches attached to the knee section of said main outer assembly.

25. The protective shin guard according to claim 9, wherein 60-90 weight percent (%) of said woven blend of fibers are cut-resistant fibers and 10-40 weight % of said woven blend of fibers are elasticized fibers.

26. The protective shin guard according to claim 25, wherein said tubular cut-resistant calf-sleeve comprises a lower circumferential region and an upper circumferential region, and said lower circumferential region has a smaller circumference than said upper circumferential region.

27. The protective shin guard according to claim 26, wherein said lower circumferential region comprises a weigh % of elasticized fibers that, when worn by a wearer, are configured to compressedly secure said tubular cut-resistant calf-sleeve to an ankle of said wearer without a strap extending underneath a foot of said wearer.

28. The protective shin guard according to claim 27, wherein said lower circumference region, when not worn by said wearer, has a circumference that is configured to be less than a circumference of said ankle of said wearer.

29. The protective shin guard according to claim 28, wherein a bottom edge of is sewn along an edge of said tubular cut-resistant calf sleeve.

30. The protective shin guard according to claim 29, wherein said inner-liner comprises a lower shin pad, and said lower shin pad is sewn along an edge of said tubular cut-resistant calf sleeve.

* * * * *